United States Patent [19]

Hollowell, Jr.

[11] Patent Number: 4,472,952

[45] Date of Patent: Sep. 25, 1984

[54] SYSTEM FOR MANAGING THE ISSUANCE AND RETURN OF SELECTED ARTICLES SUCH AS TOOLS, KEYS AND THE LIKE

[76] Inventor: Robert L. Hollowell, Jr., Rte. 4, Box 2, Hertford, N.C. 27944

[21] Appl. No.: 162,095

[22] Filed: Jun. 23, 1980

[51] Int. Cl.[3] ..... E05B 11/00; E05B 73/00

[52] U.S. Cl. ..... 70/61; 70/262; 70/389; 211/9; 211/60 T

[58] Field of Search ..... 70/61, 26 Z, 389; 211/4, 8, 9, 60 T

[56] References Cited

U.S. PATENT DOCUMENTS 2,220,786 11/1940 Grainger ..... 70/262

2,336,936 12/1943 Johnson ..... 70/61

*Primary Examiner*—Robert L. Wolfe

*Attorney, Agent, or Firm*—Mills and Coats

[57] ABSTRACT

The present invention relates to a system that inherently manages the issuance and return of selected articles such as keys, tools, and the like to a retaining or central station. Of prime importance with respect to the present invention is the fact that the system encourages the return of the removed article. More particularly, the system comprises a retaining station where the selected articles are normally maintained in a locked state. An unlocking key is provided for unlocking selected articles in order that the articles may be removed from the retaining station. To encourage the return of removed articles, the retaining station is provided with a key holding and locking assembly for retaining the unlocking key until the removed article has been returned back to the retaining station and placed in the locked mode.

2 Claims, 3 Drawing Figures

SYSTEM FOR MANAGING THE ISSUANCE AND RETURN OF SELECTED ARTICLES SUCH AS TOOLS, KEYS AND THE LIKE

FIELD OF INVENTION

The present invention relates to security systems and systems for properly maintaining an inventory of articles, and more particularly to such a system that encourages the return of articles to a retaining station by withholding an unlocking key or the like until an article is properly returned.

BACKGROUND OF INVENTION

In managing keys in a car dealership, tools in a tool room and other such articles where numerous individuals require access and use of such articles, it has always been difficult to assure the proper return of the articles after use. In such situations, it is not uncommon for the article to be misplaced, lost, or even illegally removed.

To cope with such situations, various check out systems have been utilized in the past. Typically these systems have required the individual to post an identifying tag or the like in a manner that would identify the individual last removing the article from its normally stored position. Obviously such a system works fine as long as each and every individual utilizing the system honors and abides by the rules of the system. In practice, however, it is known such systems are not honored and abided by, and as a result, articles are not always returned to their storage area and thusly articles are lost. It should be pointed out that often the failure to return such article is not an intentional act, but rather results from an oversight by the individual or simply from his or her carelessness.

Therefore, there is a need for a system and apparatus for managing the issuance and return of such articles which does not require a custodian or individual keeper, and which encourages and generally assures the return of removed articles back to their normal storage position.

SUMMARY OF INVENTION

The present invention entails a system and apparatus for managing the issuance and return of selected articles such as keys or tools to a central storage or housing station. In particular the system of the present invention is designed such that selected articles are maintained at a retaining station in a locked mode, thereby preventing their normal removal from the station. There is provided an unlocking key that is capable of unlocking respective articles such that they can be removed from the retaining station. As a part of the design of the system, there is provided key retaining means for locking and retaining the unlocking key in response to the respective articles being unlocked and removed from the retaining station. Further in order to remove the unlocking key from the retaining station, the article must be returned to the station and placed in a locked mode. The act of placing the article in the locked mode automatically releases the unlocking key and allows the same to be removed from the retaining station. Consequently, it is appreciated that in order to remove an article, an individual must utilize an unlocking key and that unlocking key cannot be removed from the retaining station until the particular article has been returned and placed back in the locked mode.

It is, therefore, an object of the present invention to provide a system for managing the issuance and return of selected articles that does not require an individual custodian or keeper and which encourages and generally assures the proper return of articles to a central retaining or housing station.

Another object of the present invention resides in the provision of a security and management system for articles that require the use of a selected key in order to remove articles from a retaining station, and which requires the proper return of the article and placement thereof in a locked mode before the unlocking key can be removed from the retaining station.

Still a further object of the present invention resides in the provision of a security and management system for articles of the character discussed above which is simple, relatively inexpensive, reliable and which is easy to use and maintain.

Another object of the present invention resides in the provision of a security management system of the character referred to above that is capable of being used for a wide variety of articles such as keys used by vehicle dealers, tools in a tool room, and the like.

Still a further object of the present invention resides in the provision of an apparatus for maintaining selected articles in a locked mode and by the provision of key means, enable respective articles to be unlocked and removed while retaining the key and which will only release the key after the article has been returned and placed back in a locked position.

Another object of the present invention resides in a security system for maintaining an inventory of articles of the character discussed above which is provided in the form of either a mechanical system or an electrical system.

Other objects and advantages of the present invention will become apparent from a study of the following description and the accompanying drawings which are merely illustrative of the present invention.

ARTICLE SECURITY SYSTEM FOR MANAGING THE ISSUANCE AND RETURN OF ARTICLES

Figure 1:
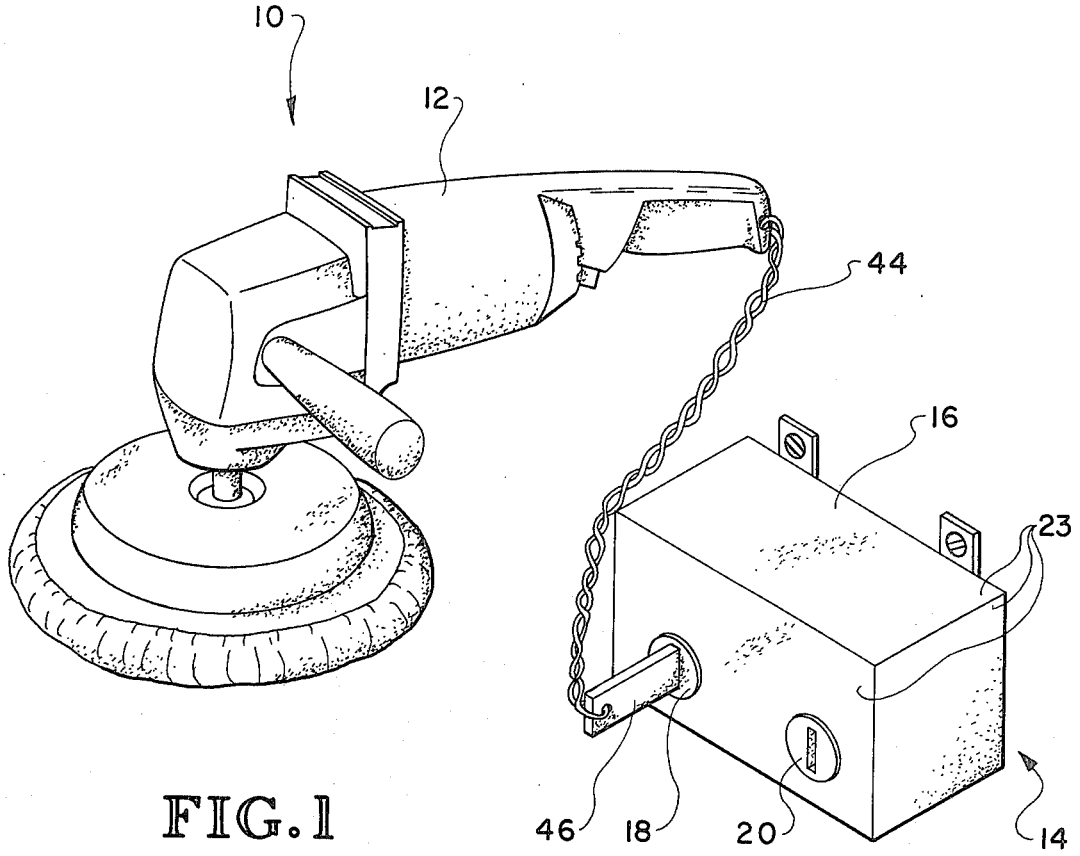
FIG. 1 is a perspective view of the article security system of the present invention wherein the illustrated article is in the form of a tool.
Figure 2:
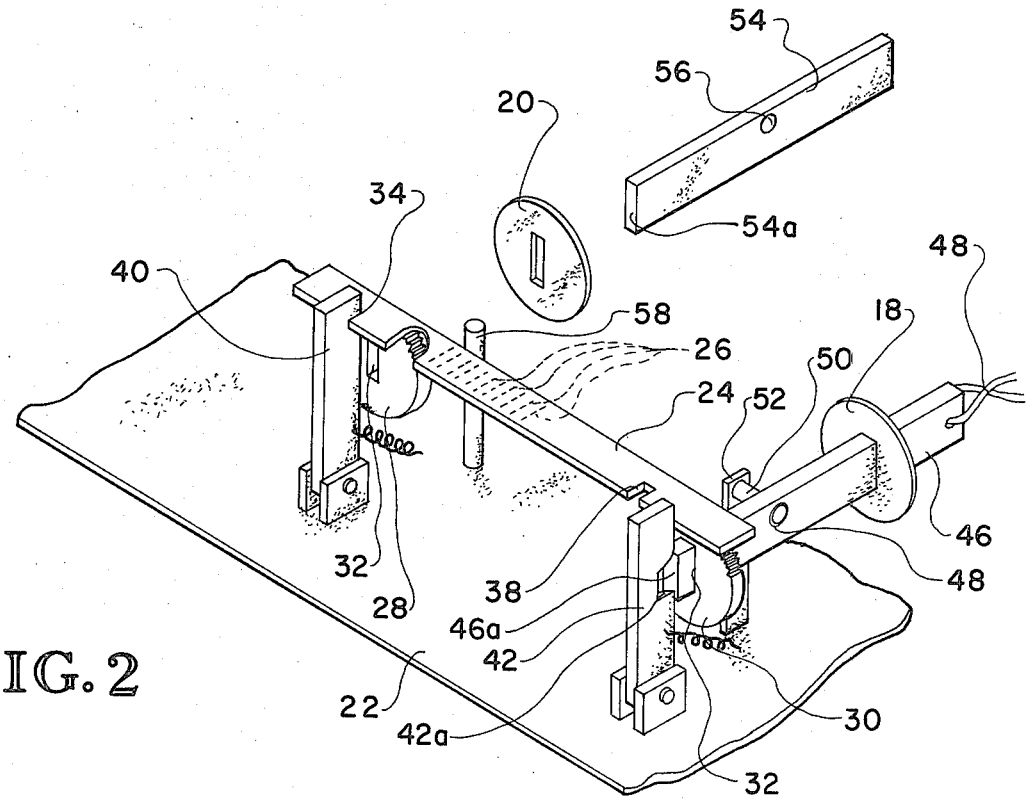
FIG. 2 is a fragmentary perspective view of a mechanical article locking and unlocking mechanism of the article security system of the present invention.

With further reference to the drawings, particularly FIGS. 1 and 2, the article security system of the present invention is shown therein and indicated generally by the numeral 10. It will be appreciated that the present system or apparatus could be utilized for various types of articles such as automobile ignition keys in a car dealership inventory or tools in a tool room, etc. But for the sake of convenience and simplicity, in the present description, the article disclosed and discussed is that of a tool 12 which as shown in FIG. 1 is a portable sander. In addition, it is to be appreciated that the present system and apparatus could be utilized in conjunction with numerous like or related articles and in fact it is in this regard that the use of the present invention is contemplated.

Reviewing the system or apparatus 10 of the present invention, it is seen that the same entails a central retaining station 14 where the respective tools or tool 12 is stored or kept. Retaining station 14 in the disclosure of FIGS. 1 and 2 includes a housing structure 16 having a pair of key inlets 18 and 20 for each article provided. Housing 16 includes a bottom 22 and a surrounding top, side and end wall structure 23.

Provided internally within housing 16 is a locking mechanism for securing the article or tool 12 about retaining station 14. Viewing this locking mechanism, the same in the case of the disclosure shown in FIGS. 1 and 2 includes an elongated locking bar 24 that includes a series of teeth means 26 formed about the underside thereof. Supporting locking bar 24 about opposite end portions is a pair of gear wheels 28 and 30 with each gear wheel being provided with a central key receiving slot 32.

In addition, as seen in FIG. 2, locking bar 24 includes a pair of locking slots 34 and 38 disposed about opposite end portions.

Mounted adjacent locking bar 24 is a pair of spring biased locking post 40 and 42. Locking post 40 and 42 are adapted to engage respective locking slots 34 and 38 formed in the locking bar 24 to lock the same in a stationary position.

Article or tool 12 includes an attaching chain 44 which is in turn secured to a locking key 46 that includes an opening 48 which is adapted to receive a locking pin 50 that is supported by support post 52.

In addition, there is provided a master or unlocking key 54 that like key 46 includes an opening 56 for receiving a locking pin 58.

In operation article 12 is in a locked and retained position as shown in FIG. 2. In this locking mode, locking pin 50 extends through opening 48 in article locking key 46. Locking key 46 extends through slot 32 formed in gear wheel 30 but gear wheel 30 cannot be turned because of the engagement of locking post 40 within slot 34 of locking bar 24.

To unlock article 12 from the retaining station 14, unlocking key 54 is inserted through inlet 20 and on through key slot 32 of gear wheel 28. Unlocking key 54 is inserted until the innermost end 54*a* engages locking post 40 pushing the same out of engagement with slot 34. This unlocks locking bar 24 and allows gear wheel 28 to be turned clockwise, as viewed in FIG. 2, by key 54. The clockwise movement of gear wheel 28 shifts locking bar 24 to the right as viewed in FIG. 2. This movement turns gear wheel 30 clockwise as viewed in FIG. 2 and in the process turns locking key 46. Locking pin 50 and opening 48 are designed such that the clockwise rotation of locking key 46 results in opening 48 being turned out of engagement with locking pin 50.

Once locking pin 50 is completely out of engagement with opening 48, unlocking key 46 can be removed and at this point due to the spring biasing of locking post 42, the same engages locking slot 38, causing locking bar 24 to be placed in a locked state.

In turning unlocking key 54 approximately one-quarter turn to achieve the unlocking of locking key 46, opening 56 is turned into engagement with locking pin 58. This locks the unlocking key 54 within the retaining station 14 since the locking bar 24 is locked by the presence of locking post 42 within slot 38.

In order to remove unlocking key 54, the article or tool 12 must be returned to the retaining station and the locking key 46 inserted into and locked within the housing 16. To accomplish the release of unlocking key 54, the locking key 46 associated with article 12 is inserted through slot 32 of gear wheel 30, engaging locking post 46 and urging the same out of slot 38. This enables locking bar 24 to be moved to the left as viewed in FIG. 2 by turning unlocking key 46 counterclockwise. As locking bar 24 moves to the left, gear wheel 28 is rotated counterclockwise such that opening 56 within unlocking key 54 rotates out of engagement with locking pin 58. Once this disengagement is accomplished, locking post 40 aligns with slot 34 and due to the spring biased nature of locking post 40 the same snaps into engagement therewith and consequently locks locking bar 24. At this point, unlocking key 54 is in the vertical position and can be freely removed from the housing 16. In the meantime, the counterclockwise rotation of article locking key 46 results in the same being turned such that the pin opening 48 therein turns into engagement with locking pin 50, thereby locking the article associated therewith.

The shape of inner end 46*a* of locking key 46 is of importance since the tapered nature thereof and the shape of the engaging slot 42*a* in locking post 42 enables the locking post 42 to snap into engagement with slot 38 when the locking key 46 is in the horizontal unlocked position.

It should be appreciated that locking bar 24 and gear wheels 28 and 30 could be provided with appropriate guide structure for supporting the same internally within housing 16 but yet allowing the respective components thereof to move.

Figure 3:
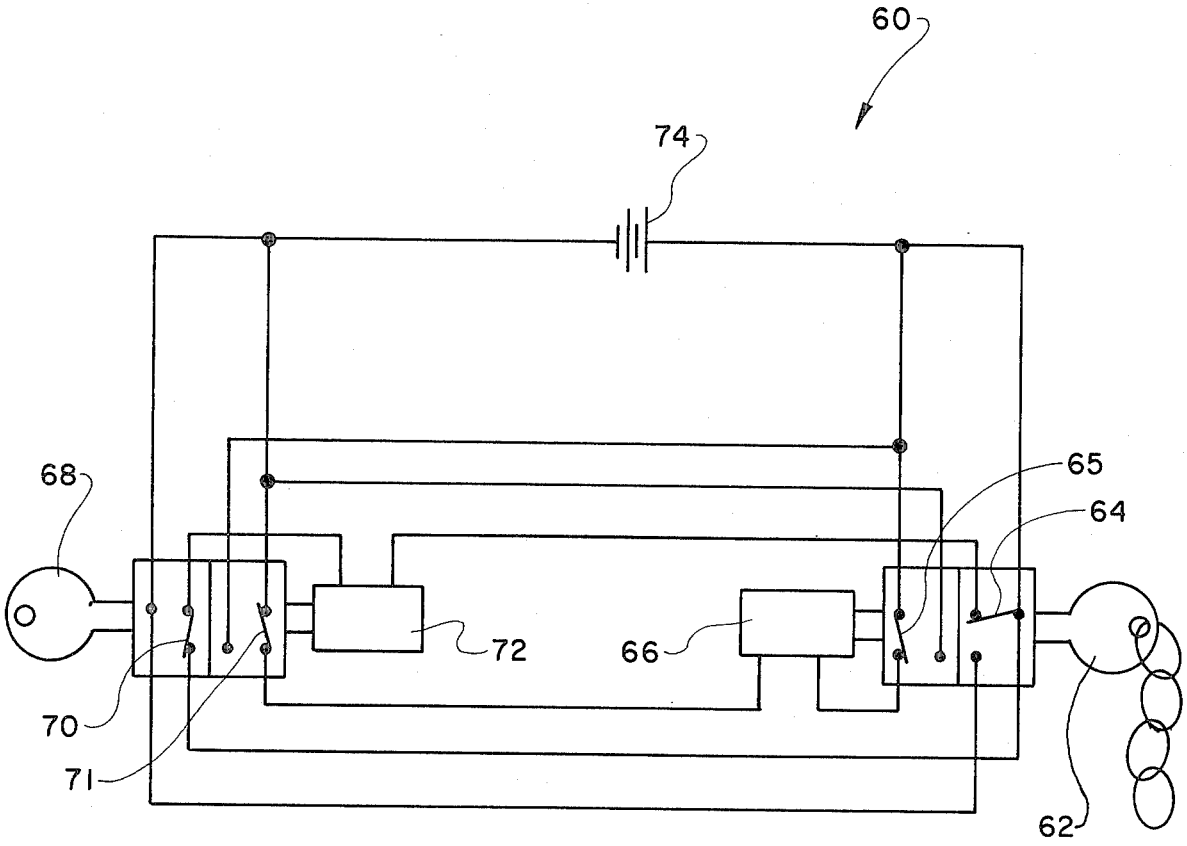
FIG. 3 illustrates an alternate electrical species for the article security system of the present invention.

Turning to FIG. 3, there is shown therein an electrical species of the basic article securing system of the present invention and this system is indicated generally by the numeral 60. In this regard, the same includes an article key 62 that is adapted to be inserted into a dual switch assembly including switches 64 and 65. There is also provided an unlocking key 68 that is adapted to be inserted within another dual switch assembly including switches 70 and 71. In addition, there is provided a solenoid 66 that when actuated by current flow is adapted to lock and retain locking key 62. In the same manner, there is provided a second solenoid 72 that when properly energized is adapted to hold and retain unlocking key 68.

In operation as shown in FIG. 3, article key 62 is held within the inserted switch assembly since solenoid 66 is actuated by a current flow therethrough by battery 74. To unlock key 62 and remove the associated tool, unlocking key 68 is inserted and turned. The turning of key 68 results in switches 70 and 71 being actuated such that they move to their alternate positions from that shown in FIG. 3. This switching of switch 71 deactivates relay 66 and allows locking key 62 to be removed. The actuation of switch 70 closes the circuit of solenoid 72 so as to actuate the same and to hold and retain unlocking key 68. Consequently, key 62 can be removed while key 68 is held in a locked state.

To remove key 68, the locking key 62 must be inserted into the dual switch assembly including switches 64 and 65. The insertion of key 62 and the actuation of switches 64 and 65 from the switch mode shown in FIG. 3, results in solenoid 66 being actuated so as to retain and lock key 62 therein while solenoid 72 is deactuated, thereby allowing unlocking key 68 to be removed.

From the foregoing specification, it is seen that the present invention presents a system and apparatus for managing the issuance and return of articles such as keys and tools to a central storage or retaining station. Of importance is the fact that the same is based on the use of an unlocking or master key to release the desired article and which retains the unlocking key until the removed article is returned and properly placed in a locked mode. The system whether mechanical or electrical is relatively simple and inexpensive, while being reliable.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A system for managing the issuance and return of a selected article or articles from a retaining station, comprising: an article retaining station for receiving and holding one or more selected articles in a locked state; article locking means associated with said article retaining station for securely locking and holding respective articles about said retaining station, said article locking means including an article locking key and means operatively associated with said retaining station for engaging and retaining said article locking key such that in a locked state said article locking key is locked and securely held about said article retaining station; key means operative with said retaining station for unlocking said article locking means and allowing a formally locked article to be removed from said article retaining station; key retaining means operatively associated with said article retaining station for engaging said key means and locking and retaining said key means relative to said retaining station in response to said article locking means being actuated by said key means and unlocked, thereby retaining said key means as a condition for the unlocking and release of said articles; said key retaining means includes a key locking pin and wherein said key means includes an opening for receiving said key locking pin, and wherein when in said retained position said key locking pin is operative to extend into said opening within said key means to prevent the removal of said key means from said article retaining station means for releasing said key means in response to said article being returned to said retaining station and said article locking means being actuated to lock said article about said article retaining station, said article locking means further including a shiftable locking bar having teeth means thereon and a pair of gear wheels operatively engaged with said teeth means for shifting said locking bar back and forth; locking post means extending adjacent said shiftable locking bar and operative to engage the same for locking the bar and preventing it from shifting; and wherein one gear wheel is provided with means for receiving said key means and the other gear wheel is provided with means for receiving said article locking key and wherein both said key means and said article locking key are adapted to engage said locking post means for unlocking the same relative to said locking bar such that the same may shift back and forth.

2. The system for managing the issuance and return of an article or articles of claim 1 wherein said locking bar includes a series of notches for receiving said locking post means wherein when said locking post means engages a respective notch said locking bar is locked and prevented from being shifted back and forth by said key means and said article locking key.

* * * * *